US007261679B2

(12) United States Patent
Sload

(10) Patent No.: US 7,261,679 B2
(45) Date of Patent: Aug. 28, 2007

(54) RUNNER TRAINING AND EXERCISE DEVICE

(76) Inventor: Jason M Sload, 20243 Laurel Hill Way, Germantown, MD (US) 20874

( * ) Notice: Subject to any disclaimer, the term of this patent is extended or adjusted under 35 U.S.C. 154(b) by 82 days.

(21) Appl. No.: 10/942,966

(22) Filed: Sep. 17, 2004

(65) Prior Publication Data

US 2006/0063651 A1 Mar. 23, 2006

(51) Int. Cl.
*A63B 21/02* (2006.01)
*A63B 23/04* (2006.01)
*A63B 5/16* (2006.01)

(52) U.S. Cl. ..... 482/124; 482/74; 482/79

(58) Field of Classification Search ..... 482/124, 482/121, 14, 15, 51, 74, 79, 81, 91, 92, 122, 482/140, 148; 600/20
See application file for complete search history.

(56) References Cited

U.S. PATENT DOCUMENTS 406,328 A * 7/1889 Yagn ..... 482/77
979,243 A * 12/1910 Anderson ..... 482/51
2,467,943 A * 4/1949 Mikell, Jr. ..... 482/79
3,411,500 A * 11/1968 Gatts ..... 600/20
4,872,665 A * 10/1989 Chareire ..... 482/51
5,203,754 A * 4/1993 Maclean ..... 482/124
5,330,417 A * 7/1994 Petersen et al. ..... 602/16
5,545,113 A * 8/1996 Bobich ..... 482/125
5,547,464 A * 8/1996 Luttrell et al. ..... 602/26
5,683,336 A * 11/1997 Pape ..... 482/124
6,099,446 A * 8/2000 Johnson et al. ..... 482/124
6,238,324 B1 * 5/2001 MacMillan ..... 482/121
6,368,256 B1 * 4/2002 Rumbaugh ..... 482/121
6,551,221 B1 * 4/2003 Marco ..... 482/74
6,709,369 B1 * 3/2004 Jacobs ..... 482/80
6,840,894 B2 * 1/2005 Lerner ..... 482/124
2002/0068667 A1 * 6/2002 Strachan ..... 482/124
2002/0094919 A1 * 7/2002 Rennex et al. ..... 482/124
2006/0240953 A1 * 10/2006 Shahinpoor ..... 482/77
2006/0240954 A1 * 10/2006 Shahinpoor ..... 482/77
2007/0015641 A1 * 1/2007 Demeniuk ..... 482/124

* cited by examiner

*Primary Examiner*—Cary E. O'Connor
*Assistant Examiner*—Victor K. Hwang

(57) ABSTRACT

The present invention is directed to an exercise and training device for runners and provides a means to train them to stay in the most efficient position for optimum muscle use and to improve speed and lateral quickness. The device comprises an upper thigh strap, a foot stirrup and a length of resilient elastic material adjustably secured therebetween and adjusted to maintain the user's knee at a 90° angle during running.

13 Claims, 4 Drawing Sheets

RUNNER TRAINING AND EXERCISE DEVICE

FIELD OF THE INVENTION

The present invention is directed to an exercise and training device for runners and provides a means to train them to stay in the most efficient position for optimum muscle use and to improve speed and lateral quickness. The device comprises an upper thigh strap, a foot stirrup and a length of resilient elastic material adjustably secured therebetween and adjusted to maintain the user's knee at a 90° angle during running. Securing the upper strap around the upper thigh places the resistive pressure of the elastic material along the quadriceps and hamstrings and effectively eliminates the strength of the hips from extending the user's leg and stretching the elastic material. The resilient elastic material may be any suitable material providing a relatively high tension elasticity. For example, rubber tubing, "bungee" cord, therapeutic elastic band such as that used in orthopedic rehabilitation, or the like. The foot stirrup comprises an arch strap that wraps around the user's foot at the arch and two separate heel straps extending rearward from the arch strap with means to secure the elastic material thereto. The heel straps serve to keep the elastic material away from the foot and to keep the heel off the ground so the user stays on his toes. The thigh strap is adapted to adjustably encircle the user's thigh and has an adjustable loop through which the elastic material passes from one heel strap to the other. The adjustability of the loop permits the device to be adjusted according to the length of the user's legs.

BACKGROUND OF THE INVENTION

When training athletes the correct mechanics of running, there are several things that both the athlete and the trainer must keep in mind and apply simultaneously and there can be a tendency to focus on one or two aspects while forgetting the others. To the extent possible, anything that can be done to apply principles subconsciously so that they become second nature to the athlete, is helpful.

One of the key aspects of running and speed drills is to maintain the correct form and motion of the legs thereby making optimum use of the muscles to generate the most power without sacrificing power and energy to wasted movement.

For speed, the optimum position for the legs is to have the knees bent at about 90° and for the athlete to run on his toes. This can be seen by watching slow motion film or video of sprinters who strive for speed over a short distance. Such athletes achieve such position, form and function through long hours of practice until it becomes second nature to adopt that position. However, while training, particularly during the early phases, it requires conscious effort on the part of the athlete and constant attention by the trainer to ensure that the correct form and position is adopted and used without lapsing to a less efficient form.

Many devices have been proposed for use to give athletes resistance during running. These include devices having elastic bands connected between the athlete's waist and ankles which, while providing resistance, permit the athlete to use all of his leg muscles from the hips on down with the result that the athlete is able to straighten his legs when running. As a result, the athlete is not trained to maintain the correct position of the legs for optimum muscle use and maximum speed. Other devices use weights attached around the hips or quadriceps to provide resistance to the hip flexors and quadriceps in driving the knees upward during running. Such devices, while potentially helping with conditioning and muscle strength, do not restrict the athlete from fully extending his legs while running and, therefore, do not train the runner to maintain the correct and efficient form for running.

What is needed is a device which is easily worn by athletes during training to maintain their legs in the correct position and form while training and which provides sufficient resistance to prevent undesired extension of the legs without a conscious effort on the part of the athlete. Such a device should be easily applied and adjustable to different heights and strengths.

SUMMARY OF THE INVENTION

It is therefore an object of the present invention to provide a runner training and exercise device which is wearable by athletes when training to maintain their legs in the correct form and position for running.

It is a further object of the present invention to provide a device wearable by athletes during training to maintain their legs in the correct form and position for running which is fully adjustable for size and strength of individual athletes.

It is a still further object of the present invention to provide a device wearable by athletes during training to maintain their legs in the correct form and position for running which is fully adjustable for size and strength of individual athletes and which can be used with a program of drills and exercise such that the maintenance of the correct position and form becomes a subconscious act for the athlete.

Further objects and advantages of the present invention will become evident from the following description and drawings.

The present invention provides a device which is easily worn by athletes during training to maintain their legs in the correct position and form for optimum muscle use and power generation without wasted motion.

The device comprises an upper thigh strap, a foot stirrup and a length of resilient elastic material adjustably secured therebetween and adjusted to maintain the user's knee at a 90° angle during running. Securing the upper strap around the upper thigh places resistive pressure of the elastic material along the quadriceps and hamstrings and effectively eliminates the strength of the hips from extending the user's leg and stretching the elastic material. The resilient elastic material may be any suitable material providing a relatively high tension elasticity.

For example, rubber tubing, "bungee" cord, therapeutic elastic band such as that used in orthopedic rehabilitation, or the like. The foot stirrup comprises an arch strap that wraps around the user's foot at the arch and two separate heel straps extending rearward from the arch strap with means to secure the elastic material thereto. The heel straps serve to keep the elastic material away from the foot and to keep the heel off the ground so the user stays on his toes. The thigh strap is adapted to adjustably encircle the user's thigh and has an adjustable loop through which the elastic material passes from one heel strap to the other. The adjustability of the loop permits the device to be adjusted according to the length of the user's legs.

Thus, the present invention provides a runner training and exercise device comprising, an adjustable upper thigh strap, an adjustable foot stirrup assembly, and an elastic resistance member secured to the thigh strap and the stirrup assembly and adjustably disposed therebetween along the back of the leg, whereby the elastic resistance member is adjustable in length to position and hold the leg at about 90° flexion of the knee.

The invention further provides a runner training and exercise device comprising: an adjustable upper thigh strap adapted to releasably encircle a user's upper thigh and having releasable securing means, the thigh strap further having an adjustable member thereon; an adjustable foot stirrup assembly comprising an adjustable arch strap adapted to releasably encircle a user's foot and having releasable securing means, the stirrup assembly further comprising at least one heel strap secured to and extending rearward from the arch strap; and an elastic resistance member comprising an elongated resilient body passing through the adjustable member and having opposite free ends secured to the at least one heel strap, whereby the elastic resistance member is disposed behind the leg and is adjustable by the adjustable member to position and hold the leg at a desired angle through the knee.

The invention provides still further a method of training athletes on speed and running form comprising: providing a training and exercise device comprising, an adjustable upper thigh strap adapted to releasably encircle a user's upper thigh and having releasable securing means, the thigh strap further having an adjustable member thereon, an adjustable foot stirrup assembly comprising an adjustable arch strap adapted to releasably encircle a user's foot and having releasable securing means, the stirrup assembly further comprising at least one heel strap secured to and extending rearward from the arch strap, and an elastic resistance member comprising an elongated resilient body passing through the adjustable member and having opposite free ends secured to the at least one heel strap; applying the device to each leg of the athlete whereby the adjustable foot stirrup assemblies are secured to the feet and the upper thigh straps are secured about the upper thighs, whereby the elastic resistance members are disposed behind the legs; adjusting the adjustable members whereby the length of the elastic resistance members between the thigh straps and the stirrup assemblies is shortened or lengthened to position and maintain the leg at a desired angle; and conducting a series of drills and exercises while wearing the device.

DETAILED DESCRIPTION OF THE INVENTION

Figure 1:
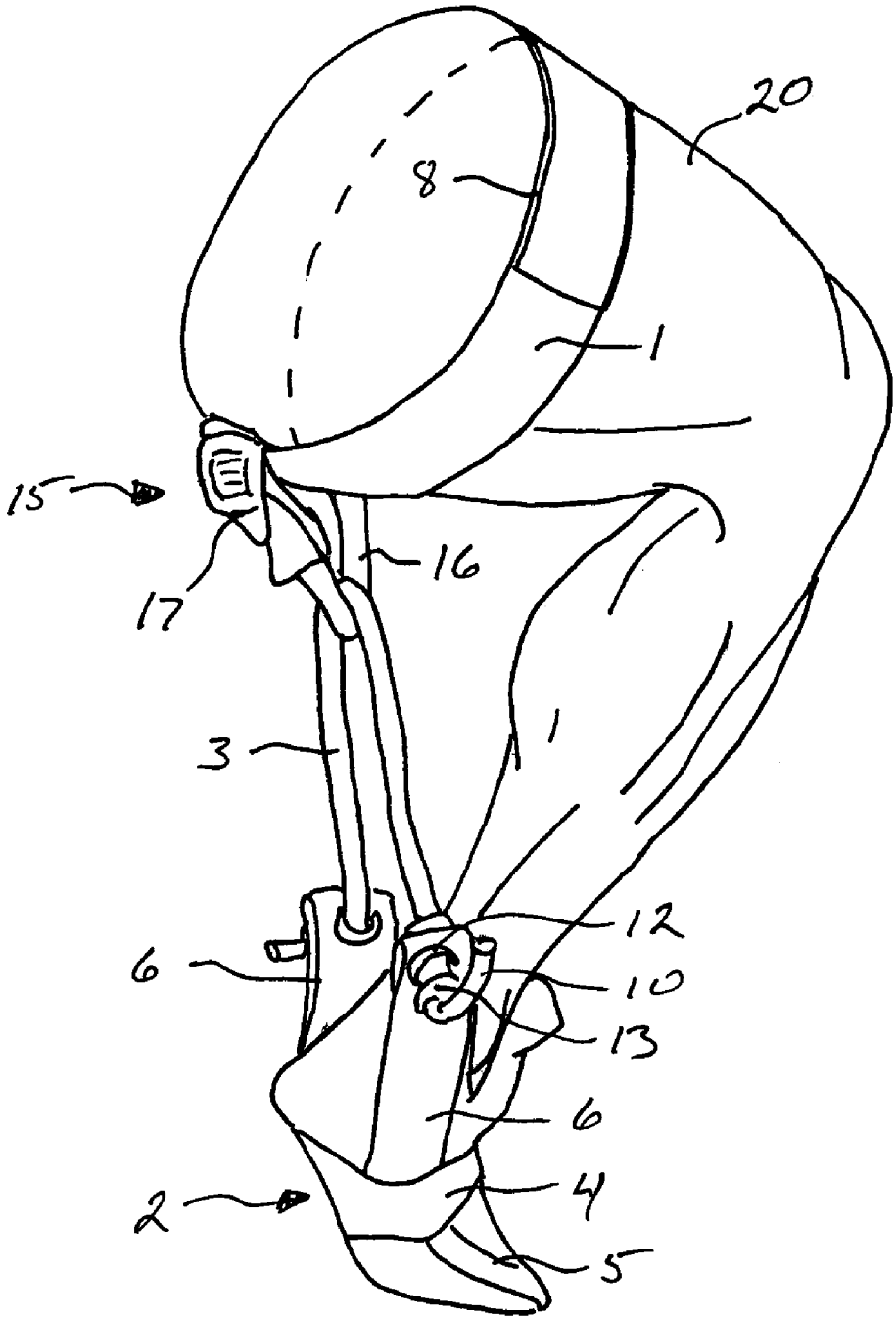
FIG. 1 is a view showing the device of the subject invention on a user's leg.

FIG. 1 illustrates a preferred embodiment of the present invention on a user's leg. The device comprises an adjustable thigh strap 1 a foot stirrup assembly 2 and an elastic resistance member 3. Foot stirrup assembly 2 comprises an arch strap 4 which encircles the user's foot 5 at the instep or arch and heel straps 6 extending rearward from arch strap 4. Thigh strap 1, arch strap 4 and heel straps 6 are preferably made from non-elastic woven strap or webbing that is flexible but of sufficient strength to resist the tension of elastic resistance member 3. Alternatively, thigh strap 1 may include an elasticized portion to allow a certain amount of flexibility in the strap 1 as the thigh muscles flex during use. Resistance member 3 may be made from any resilient elastic material providing the desired strength and resistance to stretching so as to work to maintain the user's legs bent while running. Such materials include elastic straps or webbing, rubber tubing, rubber straps, "bungee" cords, or the like.

Figure 6:
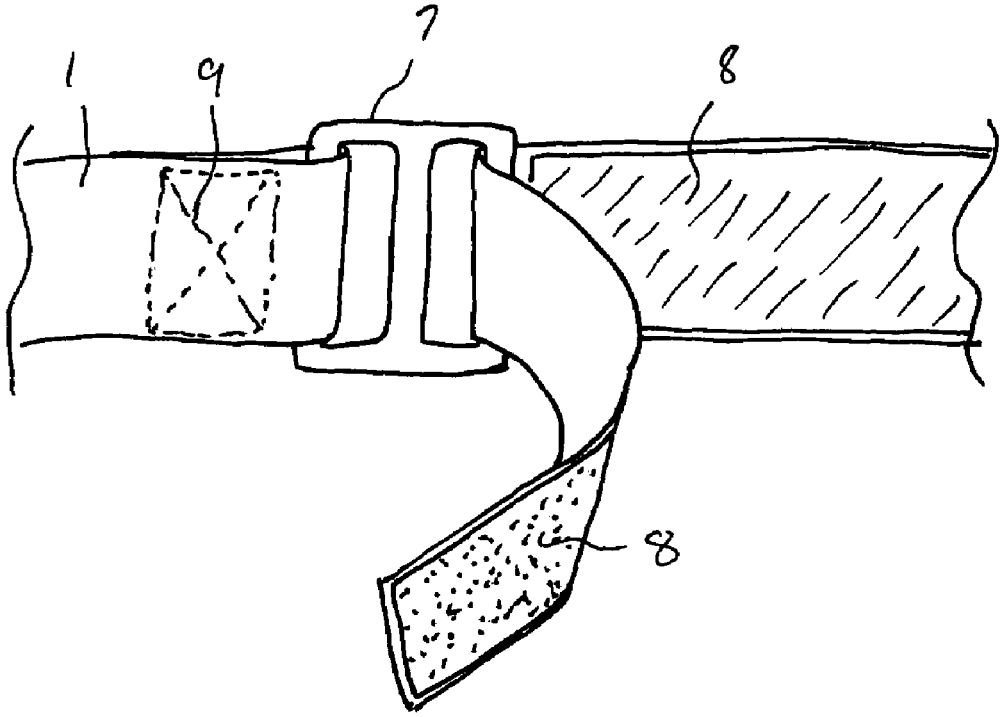
FIG. 6 is a detail view of a releasable fastening means for the thigh strap and foot stirrup assembly.

Thigh strap 1 and arch strap 4 are adjustable in length to accommodate different sizes of users and have a releasable fastening means 8, preferably a hook and loop fastener such as Velcro®, to releasably hold their ends together. Thigh strap 1 and arch strap 4 may be simple lengths of strap material that are wrapped around the thigh or foot and secured by the fastening means 8 and may have a cushioning layer 21 on one side for comfort against the skin. FIG. 6 illustrates a preferred means of adjustably fastening the thigh strap 1 and arch strap 4 wherein a buckle 7 is secured at one end of the appropriate strap by stitching 9 or other suitable non-releasable fastening means, while the other end wraps around the appropriate body part, passes through the other side of buckle 7 and is folded back over itself to secure with the releasable fastener 8. Of course other means for providing similar adjustable fastening means may be employed without departing from the scope of the present invention.

In addition to arch strap 4, the foot stirrup assembly includes at least one heel strap 6 secured to arch strap 4 and extending rearward therefrom. Preferably, heel strap 6 and arch strap 4 are secured by stitching although other non-releasable fastening means may be used. Heel strap 6 is attached to arch strap 4 so as to extend therefrom on either side of the user's heel and at an angle of from about 30° to about 60° relative to the longitudinal axis of the user's foot. In this manner, when the device is in place on the user and properly adjusted to hold the knee bent at about a 90° angle, the heel strap 6 and the elastic resistance member 3 will be substantially in line behind the leg along the hypotenuse of a triangle formed thereby in combination with the upper and lower leg.

Figure 3:
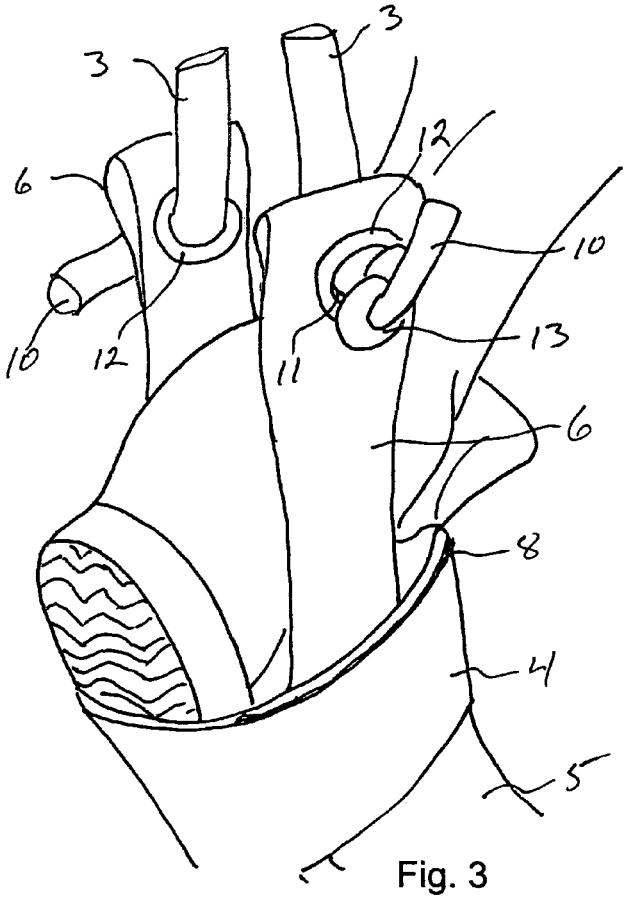
FIG. 3 is a detail view of the foot stirrup assembly of the device.
Figure 7:
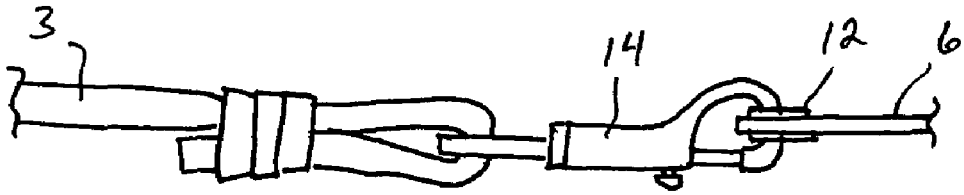
FIG. 7 is a detail view of an alternative attachment means for the elastic member.

FIG. 3 illustrates separate heel straps 6 on either side of the user's foot, with each strap having means to receive the free ends 10 of elastic resistance member 3. Such means may simply be holes 11 in the ends of heel straps 6, which holes are preferably reinforced with grommets 12. In such a structure the ends 10 of resistance member 3 may be passed through the holes 11 and knotted 13 to prevent them from passing back through. Alternatively, ends 10 of elastic resistance member 3 may be provided with clips, such as swivel clips 14, which may be used to releasably clip elastic resistance member 3 to heel straps 6 through the holes 11 and grommets 12 as shown in FIG. 7. In this manner, elastic resistance member 3 may be easily changed in the event of breakage or the desire to use a stronger or weaker resistance member 3. Other means for securing resistance member 3 to heel straps 6 may be used without departing from the scope of the present invention.

Figure 2:
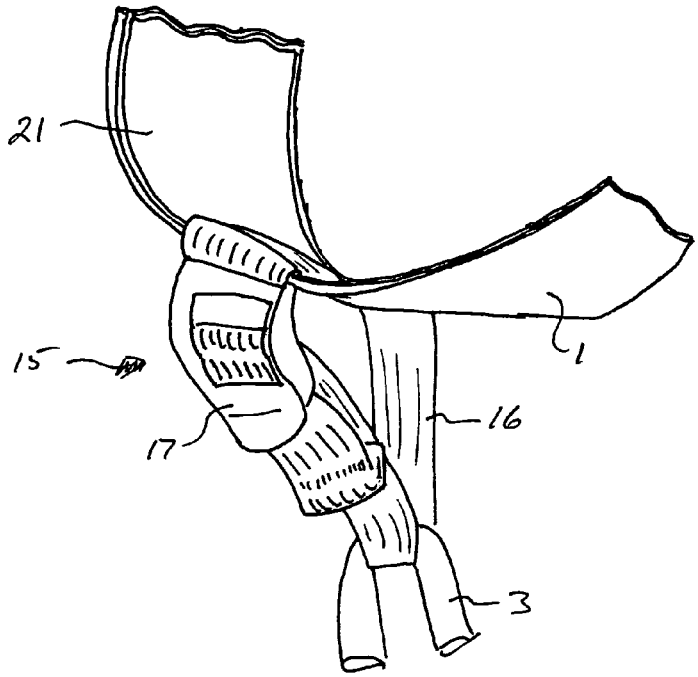
FIG. 2 is a detail view of the elastic member adjustment means on the upper thigh strap.

Although the length of resistance member 3 may be changed by changing the position of knots 13, it is preferred that a simpler adjustment means be provided. In the principal embodiment of the device illustrated in FIG. 1, resistance member 3 comprises a length of elastic tubing that is secured to each of the heel straps as shown in FIG. 3, and passes through an adjustable loop 15 on thigh strap 1. Adjustable loop 15 comprises a strap 16 secured to thigh strap 1 by stitching or other non-releasable fastening means and having a longer portion extending downward from the lower edge of thigh strap 1 and a shorter portion extending from the upper edge of thigh strap 1. Shorter portion is provided with a releasable buckle or grip clip type fastener 17 through which the longer portion of strap 16 passes and is adjustable to make loop 15 larger or smaller. With resistance member 3 passing through loop 15 as shown in FIG. 2, adjusting the size of loop 15 by lengthening or shortening strap 16 in fastener 17 will have the effect of lengthening or shortening the effective length of resistance member 3 between thigh strap 1 and stirrup assembly 2, thus permitting the device to be adjusted for different users.

Figure 4:
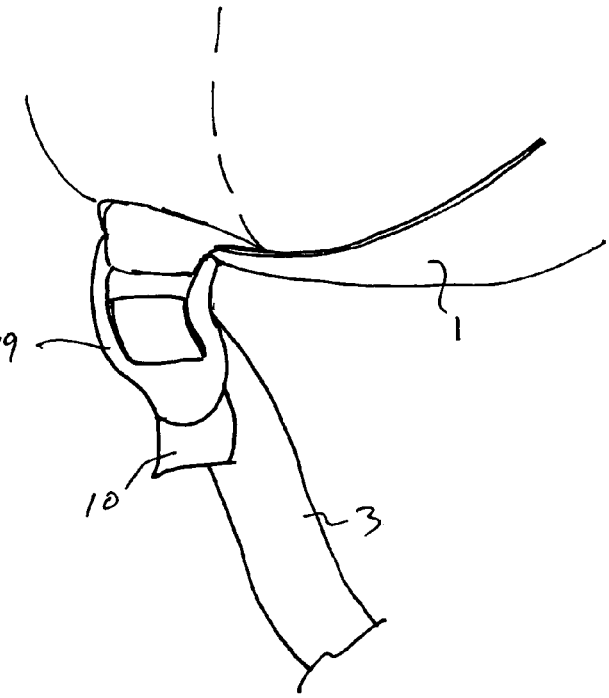
FIG. 4 is a detail view of an alternative elastic member adjustment means on the upper thigh strap.
Figure 5:
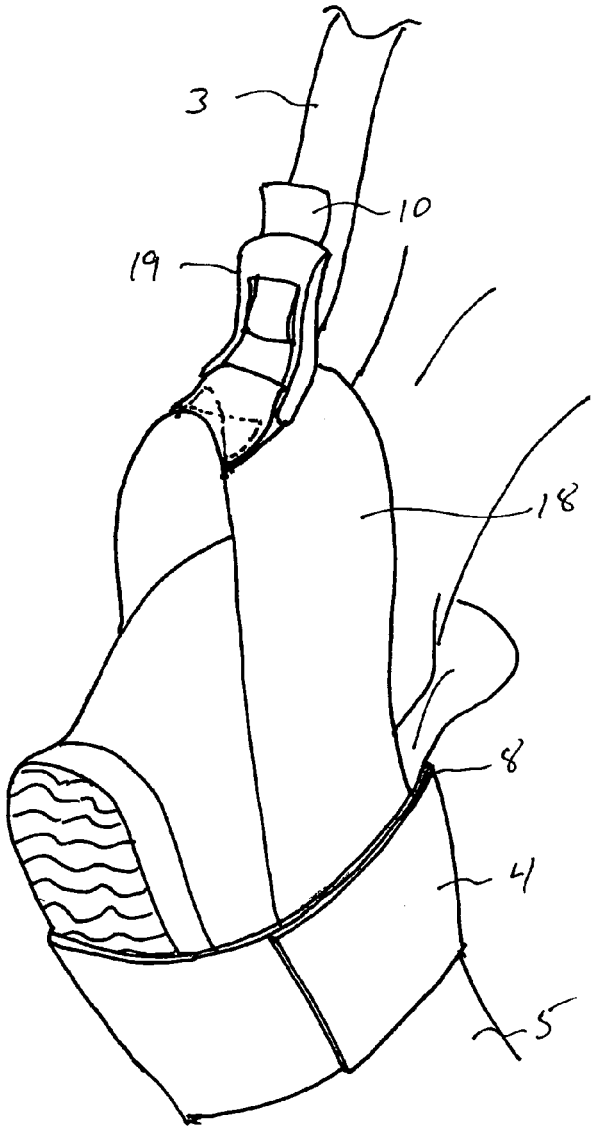
FIG. 5 is a detail view of an alternative foot stirrup assembly and elastic member adjustment means thereon.

In an alternative embodiment shown in FIGS. 4 and 5, heel strap 6 is in the form of a loop 18 of the strap material secured at each end to opposite sides of arch strap 4 and extending beyond the user's heel. Non-releasably secured to the back of loop 18 is a releasable buckle fastener 19 through which the end 10 of resistance member 3 passes and is held in an adjustable manner. Thigh strap 1 is provided with a similar releasable buckle fastener 19 that is non-releasably secured to thigh strap 1 and through which the other end 10 of resistance member 3 passes and is held in an adjustable manner. In this embodiment, the effective length of resistance member 3 is adjustable directly through the buckles 19 and may be released for replacement simply by removing the ends 10 from the buckles 19. Instead of buckles 19 of the type shown in FIGS. 4 and 5, releasable grip clamps or other releasable fastening means that will securely hold the ends 10 of the resistance member 3 during use of the device may be employed without departing from the scope of the present invention.

In use, a runner is provided with one device for each leg. The arch strap 4 is wrapped about the foot 5 at the instep or arch with the heel strap 6 extending rearward and the releasable fastening means 8 is secured to prevent slippage of the strap 4. The thigh strap 1 is wrapped about the upper thigh 20, preferably at a point just below the lower curve of the buttocks, and the releasable fastening means 8 is secured to prevent slippage of the strap 1 downward but not so tight as to impede circulation within the leg. Thigh strap 1 is positioned on the runner's thigh 20 so that loop 15 or buckle 19 is at the back of the thigh 20 above the heel. In this manner, resistance member 3 will span the distance between thigh strap 1 and heel strap 6 behind the leg without rubbing against the leg as shown in FIG. 1. With thigh strap 1 and stirrup assembly 2 properly positioned and fastened, the length of resistance member 3 is adjusted through either loop 15 or buckles 19 so that the runner's leg assumes a 90° angle through the knee. In this position, the runner is forced to assume a crouch like that of a sprinter with the heels off the ground and the runner's weight on the toes and balls of the feet. Preferably, the resistance provided by the elastic resistance member 3 is sufficient to maintain this position against normal extension of the leg during running but not so great as to positively prevent such extension. With the device properly positioned and adjusted, the runner is effectively prevented from using the strength through the hips to extend his legs and must solely focus on the quadriceps, hip-flexors and hamstrings that will generate the muscular force to maintain the crouch position without the device.

With the device in position, as long as the runner maintains his correct crouch, there will be no feeling of tension or resistance from the resistance member 3, which will tell the runner that his legs are at the correct angle. Any attempt to extend the legs during use will result in tension being applied through the resistance member 3 thus providing the runner with immediate knowledge that he is not in the correct position. The device thus trains the runner to remember the feeling of the proper technique and correct position required for efficient use of the leg muscles so there is no wasted movement and force is generated out of every turn and push from the lower body.

When conducting running drills with the device, it is important that such drills be of short duration, i.e., no more than thirty yards at a time to avoid muscle fatigue. Rest time between drills is spent sitting on the ground so that, even with the knees bent, the legs are not under tension and the muscles can rest. With high resistance, the device is intended for teaching correct form and position rather than conditioning.

However, with different strength resistance members 3 installed, the device has utility in conditioning and strengthening of the leg muscles through the use of different drills such as a quick leg extension in which the user quickly extends the leg against the resistance of the resistance member 3 to a position as far as possible toward straight and then immediately relaxes. This has the effect of improving the speed of leg motion.

In further drills, the device has utility in working on the endurance of the quadriceps and hip flexors by a static hold drill in which the user remains in a stationary squat with the heels off the ground while maintaining pressure on the leg muscles, not the knee joints, until the muscles begin to feel as though they will fail to support this position. The user then makes a controlled drop to the ground to rest and, when control of the muscles is regained, repeats the exercise.

An additional drill is a squat jump. With the device in position, the user performs a jump from the squat position bringing his knees up to his chest with the heels against the buttocks, then dropping the knees to land on his toes. This exercise works on the same form as is used during running. The muscles are used to control landing in the squat position and prevent all of the landing pressure from falling on the knees.

While the invention has been described with respect to certain specific embodiments, it will be appreciated that many modifications and changes may be made by those skilled in the art without departing from the spirit of the invention. It is intended, therefore, that all such modifications and changes are within the true spirit and scope of the invention as recited in the following claims.

What is claimed is:

1. A runner training and exercise device comprising:

an adjustable upper thigh strap adjustably positionable about the upper thigh and below the buttocks of a human user, wherein said adjustable thigh strap comprises means to adjustably secure said strap about a user's thigh, an adjustable foot stirrup assembly adjustably attachable to the foot of said user, said stirrup assembly comprising an arch strap adapted to encircle said user's foot forward of the ankle, said arch strap having releasable adjustment means, and at least one heel strap secured to said arch strap and extending rearward from said arch strap along the side of said foot to extend behind said user's heel and at an angle of from 30° to 60° relative to the longitudinal axis of said user's foot, and an elastic resistance member secured to said thigh strap and said heel strap of said stirrup assembly behind the foot and adjustably disposed therebetween along and in line with the back of the leg between the heel and the back of the upper thigh and not extending above the upper thigh, wherein said at least one heel strap comprises means to securely connect to said elastic resistance member, whereby said elastic resistance member is adjustable in length to position and hold the leg at about 90° flexion of the knee and wherein said foot stirrup assembly comprises two heel straps secured to and extending rearward from said arch strap on opposite sides of the user's foot, each heel strap having means to securely connect to one end of said elastic resistance member.

2. The runner training and exercise device of claim 1 further comprising an adjustment means on said thigh strap adapted to receive said elastic resistance member and wherein said elastic resistance member comprises an elongated body securely connected to said adjustable foot stirrup assembly and passing through said adjustment means on said thigh strap, whereby the effective length of said elastic resistance member between said thigh strap and said foot stirrup assembly is adjustable.

3. The runner training and exercise device of claim 2 wherein said elastic resistance member comprises elastic tubing.

4. The runner training and exercise device of claim 2 wherein said elastic resistance member comprises a rubber strap.

5. The runner training and exercise device of claim 1 further comprising releasable securing means affixed to said thigh strap and to said at least one heel strap, and said elastic resistance member comprises an elongated body having two free ends wherein one free end is held by said releasable securing means affixed to said thigh strap and the other free end is held by said releasable securing means affixed to said at least one heel strap, said free ends being adjustable within said releasable securing means, whereby said elastic resistance member is adjustable therein to different lengths.

6. A runner training and exercise device comprising:

an adjustable upper thigh strap adapted to releasably encircle a user's upper thigh below the buttocks and having releasable securing means, said thigh strap further having an adjustable loop member thereon, an adjustable foot stirrup assembly comprising an adjustable arch strap adapted to releasably encircle a user's foot forward of the ankle and having releasable securing means, said stirrup assembly further comprising at least one heel strap secured to said arch strap and extending rearward from said arch strap along the side of said foot to extend behind the heel, and an elastic resistance member comprising an elongated resilient body passing through said adjustable loop member and having opposite free ends secured to said at least one heel strap, whereby said elastic resistance member is disposed behind and in line with the leg between the heel and the back of the upper thigh and not extending above the upper thigh and is adjustable by said loop member to position and hold the leg at a desired angle through the knee, wherein said foot stirrup assembly comprises two heel straps secured to and extending rearward from said arch strap on opposite sides of a user's foot, one free end of said elastic resistance member being secured to one of said heel straps and the other free end of said elastic resistance member being secured to the other of said heel straps.

7. The runner training and exercise device of claim 6 wherein said elastic resistance member comprises elastic tubing.

8. The runner training and exercise device of claim 6 wherein said elastic resistance member comprises a rubber strap.

9. The runner training and exercise device of claim 6 comprising a plurality of interchangeable elastic resistance members of different tensions.

10. A method of training athletes on speed and running form comprising:

providing a training and exercise device coitiprising, an adjustable upper thigh strap adapted to releasably encircle a user's upper thigh below the buttocks and having releasable securing means, said thigh strap further having an adjustment means thereon, an adjustable foot stirrup assembly comprising an adjustable arch strap adapted to releasably encircle a user's foot forward of the ankle and having releasable securing means, said stirrup assembly further comprising at least one heel strap secured to said arch strap and extending rearward from said arch strap along the side of the foot to extend behind the heel, and an elastic resistance member comprising an elongated resilient body securely connected to said at least one heel strap and passing through said adjustment means on said thigh strap, applying said device to each leg of said athlete whereby said adjustable foot stirrup assemblies are secured to said feet and said upper thigh straps are secured about said upper thighs, whereby-said elastic resistance members are disposed behind and in line with the legs between the heel and the back of the upper thigh and not extending above the upper thigh, adjusting said adjustment means whereby the length of said elastic resistance members between said thigh straps and said stirrup assemblies is shortened or lengthened to position and maintain the leg at a desired angle, and conducting a series of drills and exercises while wearing the device.

11. The method of claim 10 comprising adjusting said adjustment means through which said elastic resistance members pass whereby the length of said elastic resistance members is such that each leg is maintained at an angle of 90° through the knees.

12. The method of claim 11 comprising providing said training and exercise device in pairs.

13. The method of claim 12 wherein said drills comprise short sprints, side steps and squat jumps.

* * * * *